US006878043B1

(12) United States Patent
Junker

(10) Patent No.: US 6,878,043 B1
(45) Date of Patent: Apr. 12, 2005

(54) ROUGH- AND FINISH-GRINDING OF A CRANKSHAFT IN ONE SET-UP

(75) Inventor: Erwin Junker, Buehl/Baden (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 0 days.

(21) Appl. No.: 09/980,764

(22) PCT Filed: Apr. 20, 2000

(86) PCT No.: PCT/EP00/03633

§ 371 (c)(1),
(2), (4) Date: Jan. 2, 2002

(87) PCT Pub. No.: WO00/66323

PCT Pub. Date: Nov. 9, 2000

(30) Foreign Application Priority Data

Apr. 30, 1999 (DE) ..... 199 19 893

(51) Int. Cl.[7] ..... B24B 1/00

(52) U.S. Cl. ..... 451/49; 451/57; 451/249; 451/251

(58) Field of Search ..... 451/49, 57–58, 451/246, 249–251

(56) References Cited

U.S. PATENT DOCUMENTS

| | | | | |
|---|---|---|---|---|
| 3,878,651 A | | 4/1975 | Nakada et al. | |
| 5,052,154 A | | 10/1991 | Lehmann | |
| 5,863,239 A | * | 1/1999 | Barton, II | 451/65 |
| 6,334,806 B1 | * | 1/2002 | Sano et al. | 451/5 |
| 6,409,573 B1 | * | 6/2002 | Mukai et al. | 451/5 |
| 6,419,563 B1 | * | 7/2002 | Ido et al. | 451/57 |

FOREIGN PATENT DOCUMENTS

| | | |
|---|---|---|
| DE | 2047927 A | 4/1971 |
| DE | 2333041 A | 1/1975 |
| DE | 4327807 A1 | 3/1995 |
| DE | 19511881 A1 | 10/1996 |
| GB | 1 334 516 | 6/1967 |
| WO | WO 99/32258 A | 7/1999 |
| WO | WO 00/09290 A | 2/2000 |

OTHER PUBLICATIONS

Langdon R: "High Precision Machining" Automotive Engineer, GB, Mechanical Engineering Publ. Ltd. Bury St. Edmunds, vol. 21, No. 1, Feb. 1, 1996, pp. 50–52.

CAWI I: "NC–Gesteuertes Schleifen Von Kurbelwellen–Hublargern", ZWF Zetischrift Fur Wirtschaftliche Fertigung und Automatisierung, DE, Carl Hanser, Verlag. Munchen, vol. 92, No. 4, Apr. 1, 1997.

Podminky zkousek pro obrabeci centra –Cast 3: Zkousky geometricke presnosti stroju s integrovanymi indexovatelnymi nebo souvisle rizenymi universalnimi hlavami (svisla osa Z) NSST 20105–3, str. 4 (ISO 10791–3: 1998).

1996 Kurbelwellen im Pendelhub schleifen Werkstatt Werkstatt und Betrieb vol. 129, No. 1–2 p. 50.

1996 Sercos fur schnelle und genaue Maschinen, Werkstatt und Betrieb vol. 129, No. 7–8 p. 654.

Sep. 10, 1997 Technical proposal of Kurbelwellen–Schleifmaschine CR41 CBN of Schaudt; Prospectus of Schaudt Maschinenbau GmbH, Stuttgart and Chemnitz, and also communication to EMO, Hannover of Sep. 10, 1997.

(Continued)

*Primary Examiner*—Eileen P. Morgan
(74) *Attorney, Agent, or Firm*—Jordan and Hamburg LLP

(57) ABSTRACT

Method of grinding a concentrically clamped crankshaft, a crankshaft grinding machine for carrying out the method, and a crankshaft of high-alloy steel or cast material. The method provides for pin journals and main journals of the crankshaft to be ground in one set-up such that first, at least the main journals are rough-ground and then the pin journals are finish-ground and after that the main journals are finish-ground. The crankshaft grinding machine forms a machining center by means of which corresponding rough-grinding and finish-grinding is possible in a single set-up.

20 Claims, 4 Drawing Sheets

OTHER PUBLICATIONS

Sep. 1994 Motion Studer "High–speed grinding/Operating process and machine requirements EMO".
Czech Standard CSN 20–0200, "Terminology of Working Machines" Prague 1975.
Crankshaft Grinding Machine, Prospectus of the firm Prince (Kingston) Enginers Ltd. 1977.
May, 1998 Automotive grinding, Technology, issues, and opportunities with CNC grinders, Tooling & Production.
Mar. 3, 1993 Chr. Tarampouskas –Industrieanlagen, Lagerliste –Werkzeugmaschinen Stand, offer for sale of used prince grinding machine, pp. 1 and 10; D–4796 Salzkotten, Germany.
Apr. 9, 2002 Jucrank 5002, Reciprocating grinding with "CBN" in high speed Prospectus of Erwin Junker Maschinenfabrik GmbH (E138 4/97 IG).
Jan. 21, 1998 Obri Bruska–vysledek tymove prace Zapadoceska univerzita v Plzni, Univerzitni noviny c.
Feb. 1998 Bruska vskutku unikatni Siemens Ceska republika, Spektrum p. 18.
May 4, 2002 Grinding is Alive and Well Manufacturing Engineering vol. 128, No. 5.
1998 Dreh–und Schleifzentrum Werkstatt und Betrieb vol. 131, No. 7–8 pp. 665–666.
1957 Vyber norem pro dilny kovoprumyslu, 4, nezmenene vydani, Prague Seidler Alois, Kolar Jiri.
1955 Prehled strojnietvi, Prague prof. Ing. BARTOS A KOL.
1982 Technicky naueny slovnik, 2, revidovane a doplnene vydani, 3. dil (J–L) SNTL, Prague.
1994 Aus Betriebsaufloesung,Maschinenmarkt, Wuerzburg 100 No. 49 p. 115.
1995 Bohren, drehen und schleifen auf Vertikal–Schleifzentren (Drilling, milling and turning in a single setup) Werkstatt und Betrieb vol. 128, No. 5 pp. 420–422.

* cited by examiner

ROUGH- AND FINISH-GRINDING OF A CRANKSHAFT IN ONE SET-UP

FIELD OF THE INVENTION

The present invention relates to a method of grinding a concentrically clamped crankshaft and to a crankshaft grinding machine for carrying out the method.

BACKGROUND OF THE INVENTION

In known methods, crankshafts are ground in a plurality of steps on different machines in a plurality of operations on grinding machines specifically equipped for this purpose.

Another method and a corresponding apparatus have been disclosed in DE 43 27 807. In this publication, a crankshaft is clamped with axial tension between locating centers of a work headstock and tailstock of a grinding machine. In this set-up, all the bearings, pin journals, flanges, journals and end faces of the crankshaft are finish-ground. In this case, at least two appropriately contoured grinding wheels are used.

It is thus known from the prior art that, on one hand, the crankshaft is produced in a plurality of machining steps on a plurality of grinding machines or is finish-ground in one set-up.

OBJECTS AND SUMMARY OF THE INVENTION

The object of the invention is to develop a method of grinding crankshafts and an apparatus with which dimensional, form and machining tolerances of the crankshaft are improved and the machining time is reduced.

This object is achieved with a method of grinding a concentrically clamped crankshaft which provides for its pin journal and main journals to be ground in one set-up in such a way that first of all at least the main journals are rough-ground and then the pin journals and after that the main journals are finish-ground. After a preliminary machining operation for example, the crankshaft is therefore left for a plurality of machining steps in one set-up from the rough-grinding up to the subsequent finish-grinding to finished size in order to achieve the required quality with regard to predetermined dimensional, form and positional tolerances. On one hand, time which would otherwise be required for resetting the machine or for clamping and unloading the crankshaft again is saved in this way. On the other hand, the claimed grinding procedure enables the stresses in the material which are released during the grinding of the bearings to be compensated for to such an extent that distortion of the crankshaft is eliminated after the machining.

An embodiment of the method provides for the pin journals to also be rough-ground in addition to the main journals. The rough-grinding of the pin journals is advantageously effected after the rough-grinding of the main journals. Since bearing points of various crankshafts usually have different shapes, such as, for example, with lateral radii and recesses, rough-grinding of the crankshaft, as shown above, enables distortion resulting from released stresses in the crankshaft to be avoided in the finished product. During the rough-grinding and finish-grinding, the flat sides are ground at the same time without the desired tolerance values being exceeded after the finish-grinding.

The production of crankshafts of heat-treated steel has proved to be an especially preferred field of use of the method and of the crankshaft grinding machine in accordance with the invention. With these crankshafts, given a previous heat treatment, there is a particularly high risk of the crankshaft being distorted on account of stresses in the workpiece which are released during the grinding operation. By the claimed procedure, this distortion is eliminated again during the finish-grinding.

A refinement of the method provides for the rough-grinding and the finish-grinding to be effected with a single grinding wheel. Another method provides for the rough-grinding and the finish-grinding to be effected with one grinding wheel in each case. On the other hand, the use of one grinding wheel for the rough-grinding and one grinding wheel for the finish-grinding enables different grinding-wheel specifications and dimensions to be utilized for the different machining in each case. A further refinement of the method provides for the main journals and the pin journals to be rough-ground and finish-ground with one grinding wheel in each case. The pin journals and main journals may have different machining tolerances. By a grinding wheel being appropriately assigned to one type of bearing of the crankshaft to be machined, it is possible to be able to appropriately match the grinding-wheel specification used.

It is advantageous if grinding is carried out with a CBN grinding wheel. On one hand, this permits high cutting speeds; on the other hand, this wheel exhibits only a small amount of wear. The service life of the grinding wheel and thus the duration of the possible engagement time are therefore increased considerably. Furthermore, the CBN grinding wheel enables maximum tolerance specifications to be maintained. Instead of CBN grinding wheels, however, corundum grinding wheels may also be used.

Especially good results with regard to an improvement in tolerances have been obtained if a CBN grinding wheel is set with a cutting speed of between 40 m/sec and 140 m/sec, preferably between 80 m/sec and 120 m/sec, and if a cutting speed of between 80 m/sec and 200 m/sec, preferably between 100 m/sec and 140 m/sec, is set in the case of electroplated CBN wheels. Furthermore, corundum grinding wheels can also be used within a range of preferably 35 m/sec to 100 m/sec, in particular 45 m/sec to 70 m/sec. These values may easily vary up and down, for example depending on the dimensions of the crankshaft and on the geometrical forms to be machined, on the exact composition of the grinding wheel, on the required surface quality, etc.

For longer crankshafts, the problem occurs that the crankshaft tends to vibrate during the machining. According to one embodiment of the method, at least one main journal is therefore ground as a steadyrest seat during the rough-grinding of the main journals in order to suppress vibrations and to support the crankshaft against bending by the machining forces. In this way, that region of the crankshaft which is not mounted is shortened. Furthermore, the use of the steadyrest serves to prevent deflection on account of the dead weight of the crankshaft in combination with the rotation during the machining.

Especially long crankshafts can be produced in one piece with high accuracy requirements according to the above method, as are required, for example, for passenger car and truck engines with a length of over 300 millimeters. On the other hand, the above method is just as suitable for producing crankshafts, for example, for small engines which have a length of 100 millimeters and above.

Furthermore, the invention provides a crankshaft grinding machine having a tailstock and a work headstock. A crankshaft having main journals and pin journals can be clamped concentrically between the tailstock and the work headstock.

Furthermore, the crankshaft grinding machine has at least one grinding headstock and at least one grinding wheel. The grinding machine forms a machining center by means of which, in a single set-up, at least the main journals of the crankshaft can be rough-ground and after that, its pin journals and then its main journals can be finish-ground with the at least one grinding wheel.

The crankshaft grinding machine is therefore a machining center, since the crankshaft does not have to be unloaded and clamped in place in another machine for the rough-grinding and finish-grinding. On the other hand, the crankshaft grinding machine provides the working means necessary for the rough-grinding and finish-grinding. Further working means existing separately from the machining center are no longer required. The grinding wheel used is preferably a CBN wheel. This permits short machining times with high quality.

A development of the crankshaft grinding machine provides for a first grinding wheel and a second grinding wheel to be arranged on the grinding headstock, in which case the crankshaft can be rough-ground by means of the first grinding wheel and can be finish-ground by means of the second grinding wheel. In this way, the crankshaft grinding machine enables different grinding wheels to be used and also makes it possible for the crankshaft to be produced with different cutting and traverse speeds in adaptation to the respective grinding wheel. The crankshaft grinding machine is preferably designed such that the main journals can be rough-ground and finish-ground by means of the first grinding wheel and the pin journals can be rough-ground and finish-ground by means of the second grinding wheel. In this way, depending on the tolerance range required, the grinding wheel used and its machining operation can be exactly matched. This enables a long service life of the grinding wheel used to be achieved with high machining quality.

Another embodiment of the crankshaft grinding machine provides for at least two headstocks having at least one grinding wheel each, in which case the crankshaft can be rough-ground and finish-ground with both grinding wheels. A development of this embodiment provides for two headstocks to be arranged on one side of the grinding machine and for a further headstock to be arranged on that side of the grinding machine which is opposite this side, and for the headstocks in each case to carry at least one grinding wheel. This permits simultaneous engagement on the crankshaft from different sides. As a result, the machining time can be further reduced. Depending on the length of the crankshaft to be machined, the crankshaft grinding machine can also be appropriately extended by further headstocks. For this purpose, the machining center has a modular construction so that the devices used, such as work headstock, tailstock, grinding headstock, etc., can be selected and fitted in adaptation to different crankshafts.

On account of the engagement of one or more grinding wheels on the crankshaft, torsion may occur over its length during the machining. This leads to a positional deviation of parts of the crankshafts during the machining, a factor which reduces the quality of the machining. It has been found that these torsional forces, which, although small, nonetheless have a considerable effect for the finished size to be achieved, and can be compensated for by the tailstock having a drive which is electrically coupled to a drive of the work headstock such that both drives run synchronously. Cutting forces which occur at the crankshaft are thus absorbed, and torsion over the length of the crankshaft is avoided.

High quality requirements, during production in the machining center, can be achieved for a crankshaft of cast material or high-alloy steel in which, in a single set-up, at least the main journals are rough-ground and after that the pin journals and the main journals are finish-ground. This can be established in particular at a length of at least 100 millimeters, in particular at least 300 millimeters, of the crankshaft on account of the tolerance grades achieved. A crankshaft which has been produced in this way has in particular maximum concentricity tolerances for the main journals which amount to 0.01 mm and less.

The rough-grinding referred to above by means of the crankshaft grinding machine is possible in two variations:

1. Rough-grinding of the blank to an intermediate size for the finish-grinding, preferably with an electroplated CBN grinding wheel, and
2. Rough-grinding after previous machining on the bearing to an intermediate size and subsequent finish-grinding, a ceramically bonded CBN grinding wheel preferably being used.

For the following machining example in the description of the drawing, the rough-grinding as described under point 2 is used. However, rough-grinding as shown under point 1 can likewise be realized by different combinations of the grinding wheel and grinding wheel arrangements. After the rough-grinding according to points 1, 2, the crankshaft is finish-ground according to the method described above.

BRIEF DESCRIPTION OF THE DRAWINGS

The following drawings show the invention with reference to an example and explains this example and further advantageous features which can be combined with those already mentioned hitherto.

DETAILED DESCRIPTION OF THE INVENTION

Figure 1:
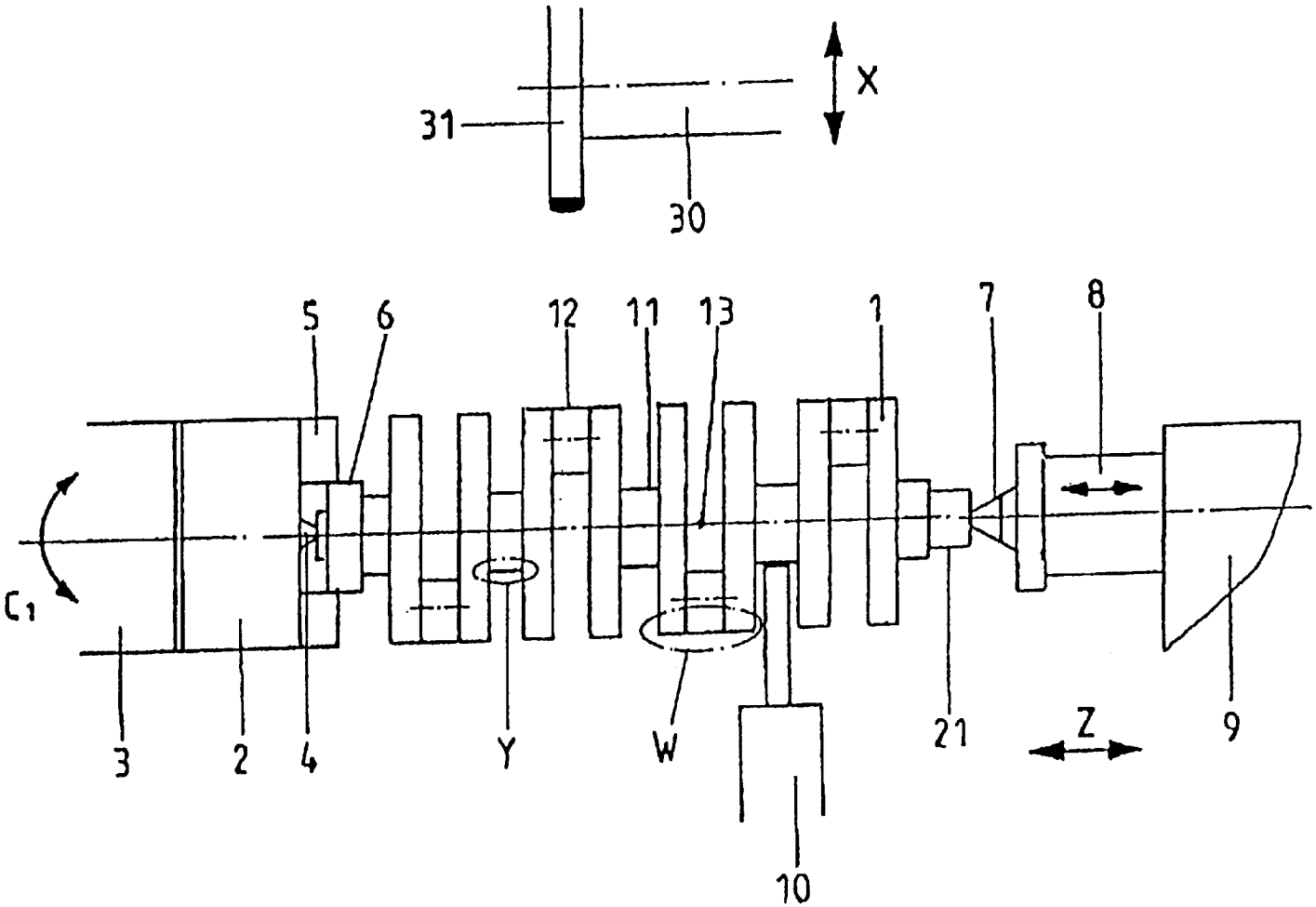
FIG. 1 shows a representation of a clamped crankshaft for illustrating the problems for achieving high quality.

FIG. 1 shows a representation of a clamped crankshaft 1. This crankshaft 1 is clamped in a chuck 2 which is flange-mounted on a work spindle 3 of a work headstock (not shown in any more detail). Located in the center of the chuck 2 is a first center 4 on which the crankshaft 1 is concentrically oriented. The crankshaft 1 is radially driven by chuck jaws 5 of the chuck 2 which grip an outer periphery of a flange 6 of the crankshaft 1. Another shaft end of the crankshaft 1 is supported by a second center 7 of a tailstock 9. The second center 7 of the tailstock 9 is mounted on an axially displaceable quill 8.

Instead of being equipped with a second center 7, the tailstock 9 may also be equipped with a further chuck, as at the work headstock, although this is not shown here. The chuck jaws of this chuck then grip a journal end 21 of the crankshaft 1.

The crankshaft 1 may be clamped under slight pressure, in a pressureless manner or even under axial tension. According to the embodiment shown in FIG. 1, the crankshaft 1 is driven by the work spindle 3 with the chuck 2 to rotate concentrically about a main journal 11. The drive is designed as a CNC axis, cf. arrow C1.

In another embodiment, the tailstock 9, instead of being equipped only with a second center 7, may also be equipped with a driven tailstock quill (CNC axis C2).

Furthermore, a grinding spindle 30 with a grinding wheel 31 is shown. The grinding spindle 30 is accommodated by a grinding headstock housing (not shown in any more detail), which is traversable in the direction of the X-axis by means of a CNC axis. The work headstock with the chuck 2 and the tailstock 9 are mounted on a grinding table (not shown in any more detail), which is traversable in the direction of a Z-axis. The crankshaft 1 is clamped such that its center axis 13 is exactly in alignment with the center axes of the work spindle 3 and the tailstock quill 8.

The crankshaft 1 is supported, for example, by means of a steadyrest 10, which is mounted on the grinding table. The steadyrest 10 can be positioned in the axial direction on a predetermined main journal 11. The grinding of the crankshaft 1 can be executed with different variations of grinding spindle arrangements, so that different construction variations of crankshaft grinding machines are possible. Some variations are set forth in FIGS. 6–8 below.

As shown in FIG. 1, the grinding wheel 31 engages on the crankshaft 1. Especially in the case of high-alloy steel, for example with a corresponding proportion of chromium, molybdenum and vanadium, or also a corresponding casting quality, for example GGG 60/70/80, there is the risk of the crankshaft 1 being distorted over its length on account of the machining. In this case, deviations of up to 0.4 mm have been measured. Accordingly, it has not been possible in the case of high-grade materials, which are extremely susceptible to distortion during machining, to be able to maintain the requisite high quality with regard to predetermined tolerances. Since at least the main journals are now rough-ground and then the pin journals and the main journals are finish-ground, the stresses released during the machining can be eliminated in such a way that the distortion which occurs is eliminated in the following operation and, for example, even concentricity tolerances of 0.01 mm and less on the main journals can be maintained.

In this case, the concentricity tolerance is preferably measured between the first and the last main journal. If there are only two main journals, the concentricity tolerance is preferably determined by measuring between the two centers. Maintaining a maximum concentricity tolerance is especially important, since, on account of the bearing arrangement in the engine, only small tolerances are admissible there. However, tolerances at the pin journal with regard to the throw may turn out to be larger if need be, since these tolerances, in the engine, merely determine the position of the top dead center and the bottom dead center.

Furthermore, when selecting the material of the crankshaft, it is to be taken into consideration that the material, inter alia, and also the hardening process for the crankshaft determine whether the rough-grinding and finish-grinding of the pin journals is effected in a single working step. At the same time, it is to be taken into account that lower stresses and distortion resulting from this occur in particular in cast shafts.

Figure 2:
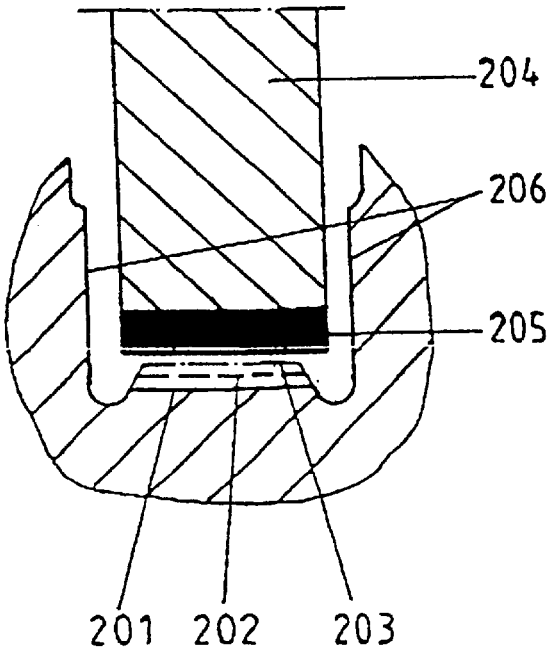
FIG. 2 shows a main journal with lateral recesses according to detail Y from FIG. 1.

FIG. 2 shows a main journal 11 with lateral recesses according to a detail Y from FIG. 1. It is shown with reference to the main journal 11 of the crankshaft 1 how contours already known previously can also be achieved with the method or the crankshaft grinding machine in accordance with the invention. The lateral recesses originate from the preliminary machining. A basic size of the crankshaft 1 is shown by a dot-dash line 203. During the rough-grinding with a grinding wheel 204, which has an abrasive layer 205, rough-grinding is carried out to a rough size 202. The rough size 202 is larger in diameter than the finished size to be achieved. The latter is depicted with a contour 201 for the main journal 11.

The two flat sides 206 of the main journal 11 of the crankshaft 1 are not ground at the same time in this exemplary embodiment.

Figure 3:
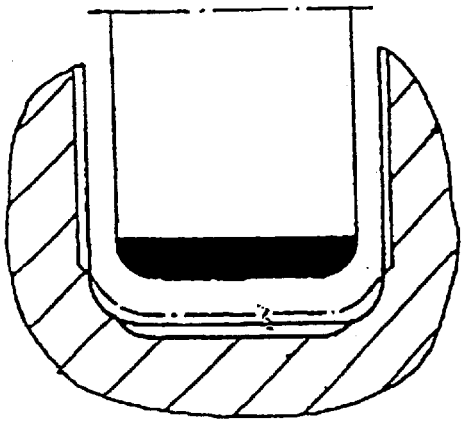
FIG. 3 shows a pin journal with lateral radii and ground flanks according to detail W from FIG. 1.

FIG. 3 shows a pin journal 12 with lateral radii and ground flanks according to detail W from FIG. 1. The pin journal 12 has lateral radii, which are rough-ground in the same way as a low flat shoulder. During the finish-grinding, the radius is no longer ground completely, since it does not come in contact in the bearing shell of the engine housing when the crankshaft 1 is fitted. The bearings shown in FIGS. 2 and 3 may likewise also be designed the other way round for a pin journal and main journal, respectively.

Figure 4:
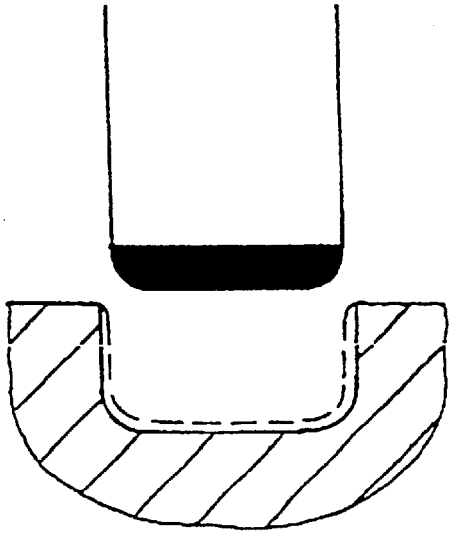
FIG. 4 shows a cross section of a first bearing point.

FIG. 4 shows a cross section of a bearing point of the crankshaft 1. This bearing point is preferably a pin journal, the bearing point being ground completely with the lateral radii and the associated flat sides.

Figure 5:
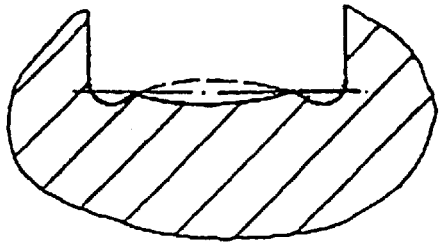
FIG. 5 shows a cross section of a second bearing point.

FIG. 5 shows a further cross section of a bearing point. A dot-dash center line represents a generating line of a cylinder. Displaced by a few micrometers from this, the bearing running surface has a crowned form, indicated by the broken line. The solid line shows an opposed form of the bearing running surface. The latter is likewise at its maximum distance from the center line of the generating line of a few micrometers. Such a convex or concave form can be produced via appropriate dressing of the grinding wheel used in accordance with the method shown above.

In order to obtain the best possible results with regard to the quality, a plurality of variations according to the method of grinding the main and pin journals are possible: for example, all the main journals including the steadyrest seat are first rough-ground. The pin journals are then rough-ground with the same grinding wheel or with a second grinding wheel. After the pin journals have been rough-ground, they are then finish-ground to the finished size, and then the main journals are finish-ground. Depending on the crankshaft type, the rough-grinding and finish-grinding of the pin journals may also be effected in one operation. A common feature of all the variations is that, irrespective of the crankshaft grinding machine selected in each case, all the main and pin journals of the crankshaft are machined to rough or finished size in one set-up.

Figure 6:
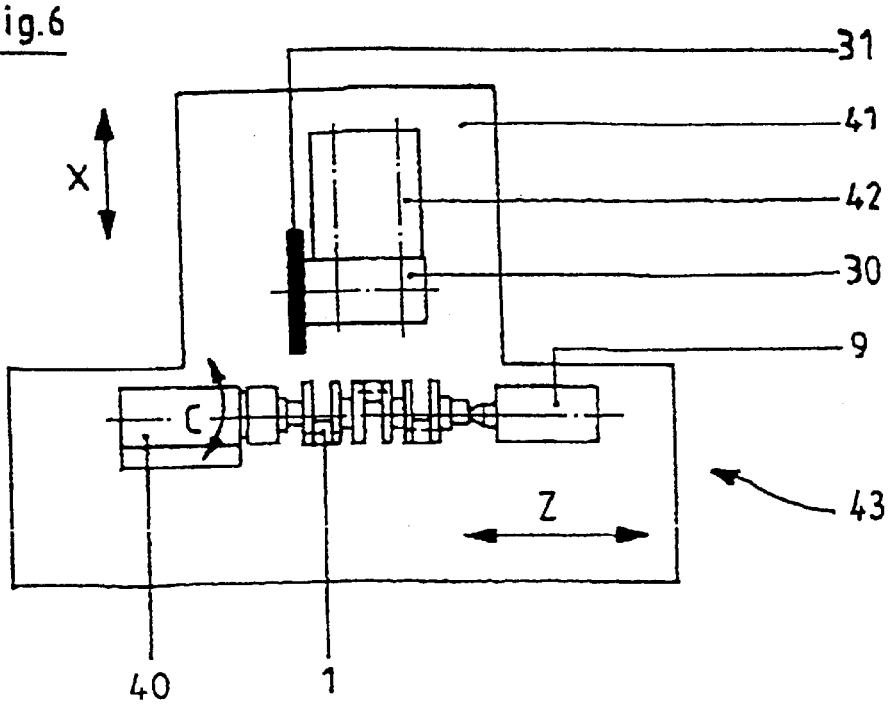
FIG. 6 shows a simplified plan view of a first embodiment of a crankshaft grinding machine in accordance with the invention.

FIG. 6 shows a simplified plan view of a first crankshaft grinding machine 43. A work headstock 40 and the tailstock 9 are mounted on a machine bed on a grinding table (not shown). The grinding table is traversable in the direction of the CNC axis z in a manner known per se. A grinding headstock 42 serves to accommodate a grinding spindle 30 which accommodates a grinding wheel. The grinding headstock 42 is arranged on a guide which is traversable in the direction of the x-axis. The CNC axis directions X and Z are preferably arranged at right angles to one another. The machining center shown enables a crankshaft 1 set-up once to be rough-ground and finish-ground according to the method described above without resetting being necessary. It is thus also possible to maintain small tolerance zones.

Figure 7:
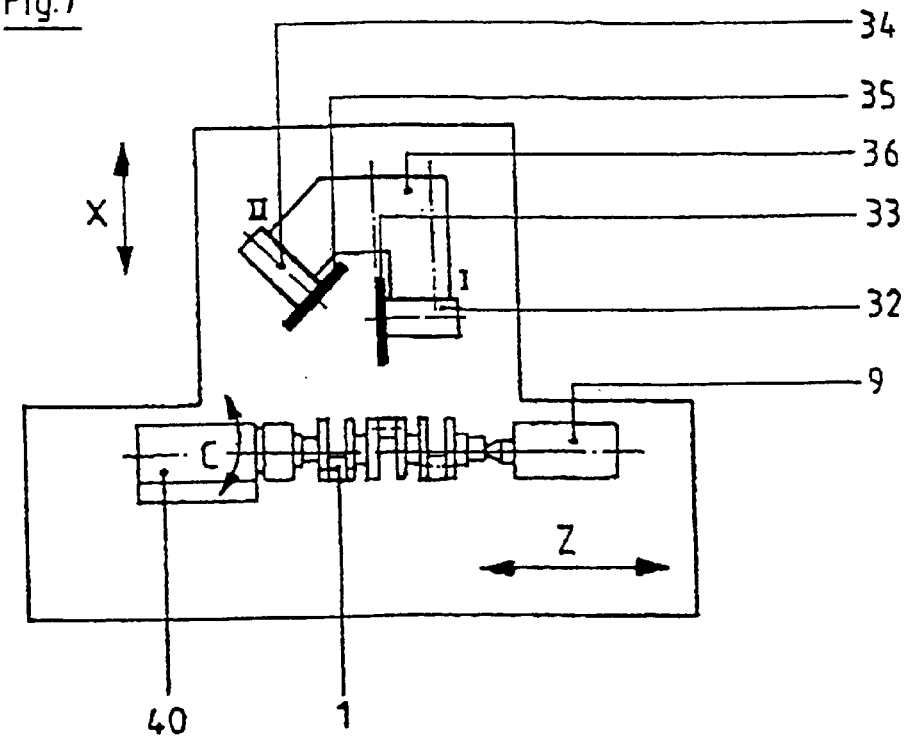
FIG. 7 shows a configuration of a grinding headstock.

FIG. 7 shows a configuration of a grinding headstock 36. The grinding headstock 36 has a first grinding spindle I and a second grinding spindle II. They are accommodated in a grinding headstock housing and can thus be swiveled in a horizontal direction. On one hand, this permits the alternative use of the first grinding spindle I or the second grinding spindle II. On the other hand, this also enables a first spindle 32 to be designed differently from a second spindle 34. For example, different speed ranges can thus be predetermined in the design. Furthermore, the grinding headstock 36 enables different grinding wheels to be used. For example, a first grinding wheel 33 may be a corundum wheel, whereas a second grinding wheel 35 may be a CBN wheel. Likewise, the design of the grinding headstock 36 enables different diameters of grinding wheels to be used on one grinding headstock. If the design is spatially divided in an appropriate manner, the grinding headstock 36 also enables one grinding wheel to be in engagement on the crankshaft, while the other grinding wheel is free. To this end, the grinding headstock 36 can be swiveled horizontally. Furthermore, in addition to different dimensions or different materials, the grinding wheels may also differ with regard to their quality to be achieved. Thus, one grinding wheel may be a roughing wheel, while the other is a finishing wheel.

Figure 8:
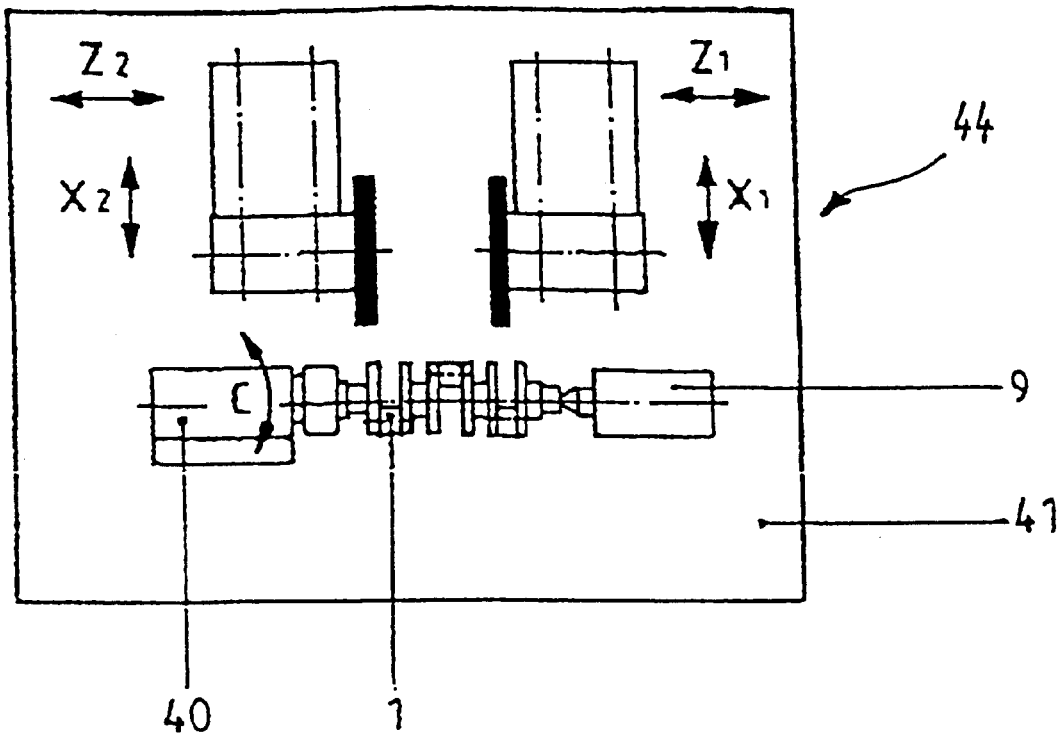
FIG. 8 shows a simplified plan view of a second embodiment of a crankshaft grinding machine in accordance with the invention.

FIG. 8 shows a second crankshaft grinding machine 44. This realizes a machine concept in which the machining center has two grinding headstocks. Each grinding headstock has CNC axes X and Z which are independent of one another. This means that the respective grinding wheel of a grinding headstock can be used independently of the other grinding wheel at a different bearing point of the crankshaft according to a CNC program. This machine concept can be extended by further grinding headstocks. In particular for utilizing the space, it is advantageous if an additional grinding headstock is arranged in opposition to the two grinding headstocks, for example opposite both. Such an arrangement, during simultaneous engagement, has the advantage that forces acting in opposition on the crankshaft neutralize one another. The spatial configuration of the machining center can also be utilized such that a grinding headstock on one side of the crankshaft has a grinding headstock directly opposite it on an opposite side of the crankshaft.

What is claimed is:

1. A method of grinding a crankshaft having pin journals and main journals in a single set-up of the crankshaft on a grinding machine, comprising the steps of:

clamping the crankshaft such that it rotates concentrically about the main journals;

first rough-grinding at least the main journals, then finish-grinding the pin journals, thereafter finish-grinding the main journals, and grinding only one of the main journals as a steadyrest seat during the rough-grinding of the main journals.

2. The method as claimed in claim 1, further comprising rough-grinding the pin journals.

3. The method as claimed in claim 2, wherein the rough-grinding of the pin journals is performed after the rough-grinding of the main journals.

4. The method as claimed in one of claims 1 to 3, wherein at least some of the rough-grinding and finish-grinding is effected with a single grinding wheel.

5. The method as claimed in one of claims 1 to 3, wherein all the rough-grinding and finish-grinding is effected with one grinding wheel.

6. The method as claimed in one of claims 1 to 3, wherein all the rough-grinding and finish-grinding of at least the main journals and the pin journals is effected with one grinding wheel.

7. The method as claimed in claim 4, wherein the grinding wheel is a corundum wheel.

8. The method as claimed in claim 4, wherein the grinding wheel is a CBN wheel.

9. The method as claimed in claim 7, further comprising the step of operating the corundum wheel at a cutting speed of about 35 m/sec to about 100 m/sec.

10. The method as claimed in claim 4, wherein the grinding wheel is a ceramic CBN wheel, further comprising the step of operating the ceramic CBN wheel at a cutting speed of about 40 m/sec to about 140 m/sec.

11. The method as claimed in claim 7, further comprising the step of operating the corundum wheel at a cutting speed of about 45 m/sec to about 100 m/sec.

12. The method as claimed in claim 17, further comprising the step of operating the corundum wheel as a cutting speed of about 45 m/sec to about 70 m/sec.

13. The method as claimed in claim 4, in wherein the grinding wheel is a ceramic CBN wheel, further comprising the step of operating the ceramic CBN wheel at a cutting speed of about 80 m/sec to about 120 m/sec.

14. The method as claimed in claim 4, wherein the grinding wheel is an electroplated CBN wheel, further comprising the step of operating the electroplated CBN wheel at a cutting speed of about 80 m/sec to about 200 m/sec.

15. The method as claimed in claim 4, wherein the grinding wheel is an electroplated CBN wheel, further comprising the step of operating the electroplated CBN wheel at a cutting speed of about 100 m/sec to about 140 m/sec.

16. The method as claimed in claim 1, wherein the rough-grinding and finish-grinding are performed with separate grinding wheels.

17. The method as claimed in claim 1, wherein all the rough-grinding is effected with one grinding wheel and all the finish-grinding is effected with a separate grinding wheel.

18. The method as claimed in claim 1, wherein all the rough-grinding of at least the main journals and the pin journals is effected with one grinding wheel and all the finish-grinding of at least the main journals and the pin journals is effected with a separate grinding wheel.

19. A method of grinding a crankshaft having pin journals and main journals in a single set-up of the crankshaft on a grinding machine, comprising the steps of:

clamping the crankshaft by means of a rotatable work spindle having a chuck such that it rotates concentrically about the main journals; and rough-grinding at least the main journals and finish-grinding the main journals and the pin journals in a sequence such that stresses in the material of the crankshaft released during the grinding are compensated for, the sequence being first rough-grinding the main journals; then finish-grinding the pin journals; thereafter finish-grinding the main journals; and grinding only one of the main journals as a steadyrest seat during the rough-grinding of the main journals.

20. The method as claimed in claim 19, further comprising the step of rough-grinding the pin journals after rough-grinding the pin journals and before finish-grinding the pin journals.

* * * * *